US006249416B1

(12) United States Patent
Daoud et al.

(10) Patent No.: US 6,249,416 B1
(45) Date of Patent: Jun. 19, 2001

(54) GROUNDING DEVICE FOR VOLTAGE SURGE PROTECTION OF TELECOMMUNICATIONS EQUIPMENT

(75) Inventors: Bassel Hage Daoud, Parsippany; Walter Pelosi, Randolph; Mikhail Sumetskiy, Bridgewater, all of NJ (US)

(73) Assignee: Avaya Technology Corp., Basking Ridge, NJ (US)

( * ) Notice: Subject to any disclaimer, the term of this patent is extended or adjusted under 35 U.S.C. 154(b) by 0 days.

(21) Appl. No.: 09/338,307

(22) Filed: Jun. 22, 1999

(51) Int. Cl.[7] ..... H01C 7/12
(52) U.S. Cl. ..... 361/119; 361/118
(58) Field of Search ..... 361/54, 56, 117, 361/118, 119, 124, 103, 104, 111; 379/412, 399

(56) References Cited

U.S. PATENT DOCUMENTS 4,733,325 * 3/1988 Loesch ..... 361/19
4,796,150 * 1/1989 Dickey et al. ..... 361/119
4,876,621 * 10/1989 Rust et al. ..... 361/58
4,958,254 * 9/1990 Kidd et al. ..... 361/119
5,587,861 * 12/1996 Wieloch et al. ..... 361/14

* cited by examiner

*Primary Examiner*—Michael J. Sherry
*Assistant Examiner*—Kim Huynh
(74) *Attorney, Agent, or Firm*—Cohen, Pontani, Lieberman & Pavane

(57) ABSTRACT

A grounding device connected to telecommunications equipment for providing protection against high voltage surges. The grounding device includes an electronic module clip having first and second legs for carrying high current of relatively short duration produced by a high voltage surge to ground. A discharge member is provided in electrical contact with the clip between the first and second legs for providing a discharge path through a mounting base to common ground for electrical current carried by the clip. The discharge member has first and second arms and a curved or bent region formed therebetween and having an opening directed toward and the base. This configuration of the discharge member causes the Lorentz force produced by a high voltage surge to be focused in the curved region which expands in a direction towards the electronic module clip to thereby ensure continued contact between the clip and discharge member.

9 Claims, 3 Drawing Sheets

GROUNDING DEVICE FOR VOLTAGE SURGE PROTECTION OF TELECOMMUNICATIONS EQUIPMENT

BACKGROUND OF THE INVENTION

1. Field of the Invention

The present invention pertains to protection devices for use with telecommunications equipment, and particularly to devices for protecting telecommunications equipment from potentially damaging current and voltage surges.

2. Description of the Related Art

Grounding mechanisms or devices are designed to protect telecommunications equipment from current surges and voltage surges by providing a grounding path in the event that either such event occurs. Grounding is necessary to prevent current and voltage surges from reaching and damaging fragile telecommunications equipment. Voltage surges typically result from lightning strikes which can generate voltages on the order of 20,000 volts.

A known solid state grounding device or protector 10 is depicted in FIGS. 1 and 2. The grounding protector 10 serves as an interface between an electronic module 12 having one or more diodes for connecting a tip wire 14 and a ring wire 16 to ground to allow the discharge of damaging voltage and current surges. The device 10 includes a pair of current sensors in the form of heat coils 18, 20, one for each of the tip and ring wires, respectively. The coils are mounted to a mounting base 32 and are biased in the downward direction relative to or toward the mounting base by tip spring 22 and ring spring 24. The heat coils 18 and 20 are maintained in an "up" or vertically offset position from the mounting base 32 by hardened solder lands or formations 30.

A leaf spring 26 is partially contained within a sleeve 28 that is mounted to module 12. The leaf spring is horizontally offset or displaced from the tip and ring heat coils 18, 20 and is in physical and electrical contact with a module or diode clip 29 for providing a grounding path from the module 12 through the base 32 for voltage surges. Particularly, the leaf spring 26 contacts the diode clip 29 at a node 46 contained within a conducting region 38 (depicted in dashed lines in FIG. 2 and shown in detail in FIG. 3) and is supported, in part, by a grounding device housing 36.

In operation, and in the event of a current surge of relatively long duration through, for example, the tip wire 14, the solder land 30 on tip heat coil 18 will melt, allowing heat coil 18 to be displaced downward under the urgency of spring 22 into abutment with base 32 and thereby connect to a common ground through base 32. Since the module 12 is connected to both the tip and ring heating coils 18, 20, the assembly will tilt slightly in a direction of the movement of the heat coil.

In the event of a voltage surge such as from a lightning strike, the arc resulting therefrom will extend or travel from the diode clip 29 to the leaf spring 26 through node 46 and be discharged to common ground through base 32. A problem that occurs, however, is that the arc will generate a force that pushes against the leaf spring 26, in the direction shown by arrow 34, thereby deflecting and permanently bending the leaf spring 26 away from diode clip 29, i.e. out of physical and possible electrical contact with module 12. This renders the prior art grounding mechanism unable to defend against any subsequently occurring voltage surges, and leaves the delicate telecommunications equipment connected through module 12 particularly susceptible to damage from such subsequently occurring voltage surges.

SUMMARY OF THE INVENTION

The present invention provides an improved grounding device for protecting telecommunications equipment from damaging voltage spikes that occur, for example, as a result of lightning strikes. The grounding device includes a mounting base to which the tip and ring wires of a communications line are connected. The mounting base provides a grounding path for allowing the discharge of voltage spikes without causing damage to telecommunications equipment connected to the tip and ring wires. An electronic module current carrying member is provided having a first leg and a second leg for carrying relatively short duration current generated from a large voltage surge along the grounding path. A voltage discharge member for discharging the relatively short duration current through the grounding path is positioned in contact with the current carrying member. The voltage discharge member includes a first arm positioned between the first and second legs of the current carrying member, a second arm connected to the mounting base, and a bent or curved region oriented in a convex direction relative to the mounting base. The voltage discharge member receives the relatively short duration current and absorbs a force produced by the large voltage surge to accommodate deformation of the curved region in a direction of the current carrying member. In this manner continued contact between the current carrying member and the voltage discharge member is ensured.

In a preferred embodiment, the voltage discharge member is configured as a "L" shaped member having a first leg in contact with an end of a current carrying member, and a second leg in contact with a mounting base and a grounding pin. The first leg has an end configured for mating with an end of the current carrying member. A force produced by a large voltage surge and the resulting current generated therefrom is directed to urge the first leg of the voltage discharge member in further contact with the current carrying member.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims.

BRIEF DESCRIPTION OF THE DRAWINGS

In the drawings, wherein like reference characters denote similar elements throughout the several views.

DETAILED DESCRIPTION OF THE PRESENTLY PREFERRED EMBODIMENTS

Figure 3:
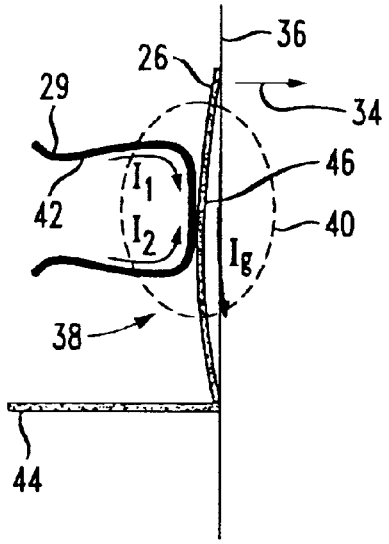
FIG. 3 PRIOR ART
FIG. 3 is a left side close-up view of a portion of the prior art grounding device depicted in FIG. 1.
Figure 4:
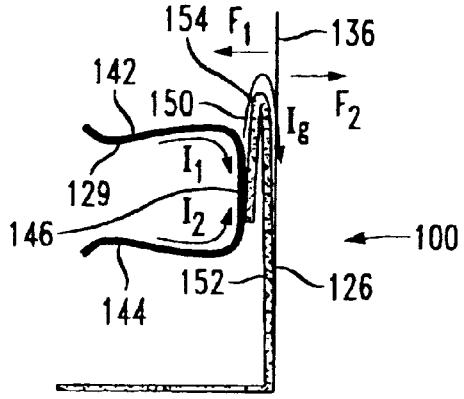
FIG. 4 is a left-side close-up view, similar to that of FIG. 3, of a corresponding portion of a grounding device constructed in accordance with the present invention.

FIG. 4 depicts the relevant portion of a grounding device 100 constructed in accordance with the invention and, more particularly, a contact region between a current carrying member 129, in the form of an electronic module clip, and a voltage surge discharge member 126. Like the prior art device 10 of FIGS. 1–3 discussed above, module clip 129 is connected to an electronic module 12 for providing an interface with the voltage surge discharge member 126. The interface yields a grounding path through discharge member 126 and through a ground terminal in the grounding device base (i.e. base 32). The module clip is configured as a substantially "U" or "C"-shaped member having a first leg 142 and a second leg 144.

Discharge member 126 is preferably implemented as a leaf spring constructed of electrically conductive material. Spring 126 is positioned between a device housing wall 136 and a current carrying member 129 and is connected to electronic common ground through the device base 32. For reasons explained more fully below, leaf spring 126 contacts current carrying member 129 at a contact point or node 146 and is configured in a particular shape to ensure continuous contact at node 146.

Turning again to FIG. 3, when a high voltage surge occurs, such as from a lighting strike applied directly or indirectly to module 12 and module clip 29, a high current of relatively short duration that is instantaneously produced must be directed to common electronic ground through the grounding path, i.e. through leaf spring 26 and base 32, to avoid damage to telecommunication equipment connected to module clip 29. As shown, the clip 29 is substantially "U" or "C"-shaped and has a first leg 42 and a second leg 44 and contacts the leaf spring within a conducting region 38 at a contact node 46. The contact node 46 defines two current paths, the first through leg 42, across node 46 and through leaf spring 26 to ground, and the second through leg 44, across node 46 and through leaf spring 26 to ground.

When the high current is produced from a voltage surge, the current can travel along both the first and second current paths through clip 29. This is shown in FIG. 3 as current $I_1$ traveling in a clockwise direction along leg 42 and in a direction of the grounding path through spring 26, and as current $I_2$ traveling in the opposite or counterclockwise direction relative to current $I_1$. The resulting grounding current is designated $I_g$ and is shown traveling along leaf spring 26 in a single direction toward base 32 to ground.

Figure 1:
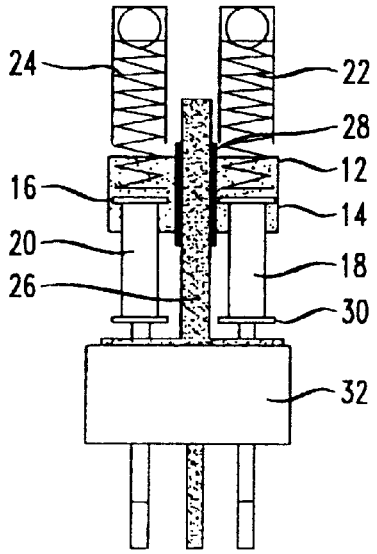
FIG. 1 PRIOR ART
FIG. 1 is a front face view of a prior art grounding device.
Figure 2:
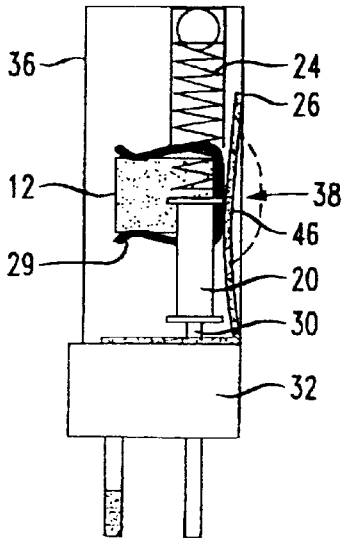
FIG. 2 PRIOR ART
FIG. 2 is a left-side view of the device of FIG. 1.

As is known in the art, a serious problem that arises when a voltage surge is applied to known grounding protectors of the type depicted in FIGS. 1–3 is the deformation and separation and loss of contact between clip 29 and spring 26 which occurs as a result of a large "explosion" caused by the Lorentz force that is produced in the direction of arrow 34 in FIG. 3. Applicants have discovered that the detrimental explosive Lorentz force is primarily the result of opposing magnetic fields generated between clip 29 and spring 26. In particular, it has been discovered that the oppositely traveling current $I_2$ along the second leg 44 of clip 29 produces a repelling magnetic field relative to the magnetic field produced by current $I_g$ in spring 26, and forces spring 26 away from and out of contact with clip 129; this has been found to be due to the overlap area of the second leg 44 with leaf spring 26 as seen in region 40.

Utilizing this discovery of the source and cause of the explosive Lorentz force which results when a high voltage surge is applied to known grounding protector devices, applicants have invented a new or modified grounding device, the relevant or modified portion of which is depicted in FIG. 4. As there shown, and as in the corresponding portion of the prior art device 10 in FIG. 3 above, the device 100 of FIG. 4 also contains a clip 142 having first and second legs 142, 144 and a leaf spring 126 which contacts clip 129 at a node 146 positioned between the first and second legs. However, in the inventive FIG. 4 device the leaf spring has been reconfigured to absorb and utilize the Lorentz force to ensure continued contact between clip 129 and spring 126.

In particular, leaf spring 126 is implemented as a continuous curved member having a first arm 150 and a second arm 152 with a curved or bent portion or region 154 defined therebetween to provide angular separation between the first and second arms. As shown in FIG. 4, the curved region 154 is oriented in a convex direction relative to the mounting base 132. The first arm 150 of leaf spring 126 contacts clip 129 between the first leg 142 and second leg 144 and defines a curved path for the grounding current $I_g$ along the leaf spring. The curved path causes the grounding current to travel in opposite directions, namely a first direction along first arm 150, and a second direction along second arm 152. As a result, an explosive Lorentz force is produced along the curved path and is focused at the first arm 150 and second arm 152 so that opposing forces $f_1$ and $f_2$ are produced in the directions indicated by the force arrows. The forces $f_1$ and $f_2$ deflect the arms 150, 152 away from each other so that arm 150 is urged into further and continued contact with clip 129, thereby ensuring against loss of continued contact with the clip for providing a discharge current path to ground.

Figure 5:
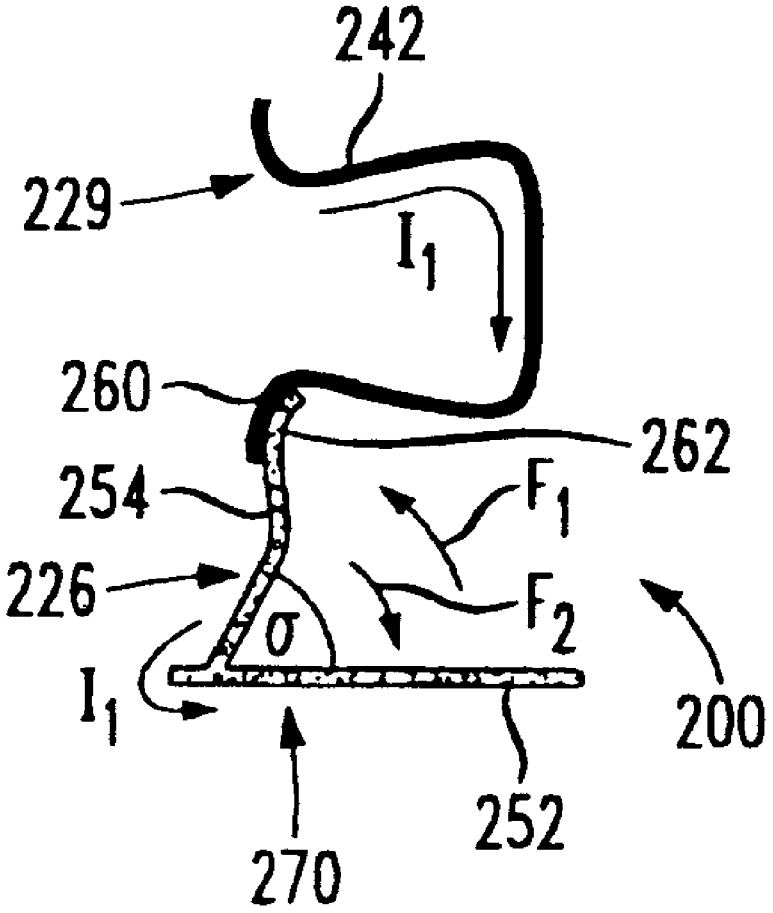
FIG. 5 is a left-side close-up view of another embodiment of the present invention.

Turning now to FIG. 5, a configuration of a grounding mechanism 200 in accordance with another embodiment of the present invention is shown. Mechanism 200 includes a reconfigured leaf spring 226 which is positioned between the mounting base (element 32 in FIG. 1) and the clip 229, as opposed to between clip 129 and housing 136 of the embodiment depicted in FIG. 4. The spring 226 has a second spring arm 252 which is connected to ground through the base and which is angularly off-set from a first spring arm 254 by an angle $\emptyset$. An end of clip 229 has a curved or mating region 260 which accommodates mating with a curved end 262 of first spring arm 254 so that curved end 262 seats within mating region 260.

In this arrangement, discharge current $I_1$ will flow in a single direction, as shown through spring 226 and to ground through the base. However, when the discharge current travels through the angled region of spring 226 (shown as region 270), the explosive Lorentz force is generated in opposite directions against spring legs 252, 254, as shown by force arrows $f_1$ and $f_2$. In this manner, the configuration of spring 229 causes arm 254 to be urged against curved clip end 260 to cause further contact therewith.

Thus, while there have shown and described and pointed out fundamental novel features of the invention as applied to preferred embodiments thereof, it will be understood that various omissions and substitutions and changes in the form and details of the devices illustrated, and in their operation, may be made by those skilled in the art without departing from the spirit of the invention. For example, it is expressly intended that all combinations of those elements which perform substantially the same function in substantially the same way to achieve the same results are within the scope of the invention. It is the intention, therefore, to be limited only as indicated by the scope of the claims appended hereto.

We claim:

1. A grounding device for providing a grounding path for a voltage surge and for maintaining the grounding path for subsequent voltage surges, comprising:

a mounting base having a terminal connectable to electronic common ground for establishing a grounding path;

a tip conductor terminal;

a ring conductor terminal;

an electronic module connected to said tip conductor terminal and said ring conductor terminal;

a current carrying member connected to said electronic module and having a first leg and a second leg for carrying current along said grounding path, said current being generated from a high voltage surge applied to said electronic module; and a voltage surge discharge member having a first arm in contact with said current carrying member, a second arm connected to said mounting base, and a bent portion formed between and unitarily connecting said first and said second arms and maintaining an angular separation between said first and second arms so that said voltage surge discharge member operatively absorbs forces produced by said current by repelling said first and second arms away from each other and thereby urging said first arm in further contact with said current carrying member to maintain continued contact between the current carrying member and the voltage surge discharge member.

2. The grounding device of claim 1, further comprising a tip current surge sensor connected between said tip conductor terminal and said mounting base for providing grounding of current surges between said tip terminal and said mounting base, and a ring current surge sensor connected between said ring conductor terminal and said mounting base for providing grounding of said current surges between said ring terminal and said mounting base.

3. The grounding device of claim 2, wherein said tip current sensor is moveably secured to and spaced from the grounding path by a meltable solder land.

4. The grounding device of claim 3, wherein said ring current sensor is moveably secured to and spaced from the grounding path by a meltable solder land.

5. The grounding device of claim 1, wherein said voltage discharge member comprises a leaf spring.

6. The grounding device of claim 1, wherein said current carrying member is configured as a substantially "U"-shaped clip.

7. The grounding device of claim 6, wherein said second leg of said current carrying member has a curved end, wherein said first arm of said voltage discharge member has a curved end configured for mating with said curved end of said current carrying member and is positioned in contact therewith, and wherein said second leg is oriented in a substantially horizontal position relative to said mounting base.

8. The grounding device of claim 1, wherein said bent portion of said voltage surge discharge member has a convex shape and orientation relative to said mounting base.

9. The grounding device of claim 1, wherein said second leg of said current carrying member has a curved end, wherein said first arm of said voltage discharge member has a curved end configured for mating with said curved end of said current carrying member and is positioned in contact therewith, and wherein said second leg is oriented in a substantially horizontal position relative to said mounting base.

* * * * *